US012559912B2

(12) United States Patent
Gales

(10) Patent No.: US 12,559,912 B2
(45) Date of Patent: Feb. 24, 2026

(54) POWER MACHINE HAND THROTTLE AND FOOT THROTTLE CONTROL

(71) Applicant: Doosan Bobcat North America, Inc., West Fargo, ND (US)

(72) Inventor: Nicolas Gales, Pouldreuzic (FR)

(73) Assignee: Doosan Bobcat North America, Inc., West Fargo, ND (US)

( * ) Notice: Subject to any disclaimer, the term of this patent is extended or adjusted under 35 U.S.C. 154(b) by 183 days.

(21) Appl. No.: 18/165,544

(22) Filed: Feb. 7, 2023

(65) Prior Publication Data

US 2023/0250615 A1 Aug. 10, 2023

Related U.S. Application Data

(60) Provisional application No. 63/307,824, filed on Feb. 8, 2022.

(51) Int. Cl.
*E02F 9/22* (2006.01)

(52) U.S. Cl.
CPC ..... *E02F 9/2253* (2013.01)

(58) Field of Classification Search
CPC ..... E02F 9/2253; E02F 9/2079; E02F 9/2235; E02F 9/2246; E02F 9/2004; E02F 9/2012; F16H 2059/082; F16H 61/465; F16H 61/47
See application file for complete search history.

(56) References Cited

U.S. PATENT DOCUMENTS 4,846,046 A * 7/1989 Kanai ..... B60W 10/06 91/506
5,056,615 A * 10/1991 Duthie ..... B60W 30/18 60/443
6,041,673 A * 3/2000 Schmillen ..... B60K 26/04 74/513
6,581,710 B2 * 6/2003 Sprinkle ..... B60K 31/04 180/178
6,655,332 B2 12/2003 Takenaka et al.
(Continued)

FOREIGN PATENT DOCUMENTS

CN 103032183 A * 4/2013
CN 109611221 A * 4/2019 ..... F02D 11/02
(Continued)

OTHER PUBLICATIONS

International Search Report and Written Opinion for International Application No. PCT/US2023/012509, mailed on Jul. 10, 2023, 15 pages.

(Continued)

*Primary Examiner* — Steve Clemmons
(74) *Attorney, Agent, or Firm* — Westman Champlin & Koehler, P.A.

(57) ABSTRACT

Power machines, control systems and methods are disclosed that automatically control engine speed and travel speed, in two different modes of operation. In a first mode of operation, both of engine speed and travel speed are controlled responsive to actuation of a foot throttle. In a second mode of operation, the foot throttle controls travel speed, but engine speed is controlled by a hand throttle. Selection of which of the first and second modes to utilize is based upon an actuation position of the hand throttle.

20 Claims, 7 Drawing Sheets

(56) References Cited

U.S. PATENT DOCUMENTS

| | | | | |
|---|---|---|---|---|
| 7,310,943 | B2 * | 12/2007 | Burgart | F16H 61/46 60/487 |
| 8,255,127 | B2 * | 8/2012 | Price | F02D 31/001 701/50 |
| 8,948,998 | B2 * | 2/2015 | Smith | F02D 31/001 123/399 |
| 9,994,105 | B2 * | 6/2018 | Roberts | F15B 13/0401 |
| 10,302,027 | B2 * | 5/2019 | Hansen | E02F 9/2062 |
| 11,105,069 | B2 * | 8/2021 | McKee | B60K 35/10 |
| 11,447,930 | B2 * | 9/2022 | Young | E02F 9/2232 |
| 12,180,683 | B2 * | 12/2024 | Oasa | F16H 61/4078 |
| 2003/0177992 | A1 | 9/2003 | Takenaka et al. | |
| 2013/0173138 | A1 * | 7/2013 | Vasichek | F02D 41/0002 701/102 |
| 2014/0324321 | A1 * | 10/2014 | Steen | F02D 41/02 701/103 |
| 2015/0151762 | A1 | 6/2015 | Gales | |

FOREIGN PATENT DOCUMENTS

| | | | | |
|---|---|---|---|---|
| DE | 29910990 | U1 * | 11/2000 | B60K 25/000 |
| EP | 1 550 803 | A1 | 7/2005 | |
| EP | 1762450 | A2 * | 3/2007 | B60W 10/02 |
| JP | 2002-81540 | A | 3/2002 | |

OTHER PUBLICATIONS

Communication pursuant to Article 94(3) EPC for corresponding European patent application No. 23 709 839.7, dated Jun. 17, 2025, 6 pages.

* cited by examiner

MODE 1

MODE 2
Engine speed set by hand
throttle at 1800 RPM

MODE 2
Engine speed set by hand
throttle at 1500 RPM

POWER MACHINE HAND THROTTLE AND FOOT THROTTLE CONTROL

CROSS-REFERENCE TO RELATED APPLICATION

This application claims the benefit of U.S. provisional application No. 63/307,824, filed on Feb. 8, 2022, the content of which is hereby incorporated by reference in its entirety.

BACKGROUND

This disclosure is directed toward power machines. More particularly, this disclosure is related to control of engine speed and travel speed in power machines.

Power machines, for the purposes of this disclosure, include any type of machine that generates power for accomplishing a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include telehandlers, loaders, excavators, utility vehicles, tractors, and trenchers, to name a few examples. While the following discussion is provided in the context of telehandler type power machines and work vehicles, the discussion is not intended to be limited to any particular type of power machine.

Operators of some types of power machines, including telehandlers, are required to control different machine functions simultaneously, using hand and/or foot controls. Travel speed and engine speed (referred to as rotations per minute or RPM) are two functions that can be controlled using a foot throttle/pedal or a hand throttle. The ability to vary the engine speed may be advantageous during the operation of the machine. For example, in some machines, the foot throttle may be biased to a minimum engine speed setting, requiring the operator to engage the foot throttle pedal to provide more than a minimum amount of engine speed. That is, these types of foot throttles can be momentarily activated devices. Alternatively, or in addition, a baseline throttle input that can be set to any engine speed setting in the engine's operation range can be employed to adjust the minimum amount (or simply set the engine speed when no momentary input such as the foot throttle discussed above is available). Because these inputs are manually controlled, even a skilled operator may command more or less engine speed than is optimal, resulting in increased fuel usage or inadequate power delivery. While it can be important to be able to separately control engine speed and vehicle speed, for example to sufficiently power the hydraulic systems to perform the above-mentioned work functions, separate control can complicate the operator's tasks. Improved control techniques for controlling engine speed and travel speed can simplify the operator's tasks, while providing the opportunity for more optimized machine control and performance.

The discussion above is merely provided for general background information and is not intended to be used as an aid in determining the scope of the claimed subject matter.

SUMMARY

Disclosed are power machines, control systems and methods which automatically control engine speed and travel speed, in two different modes of operation. In a first mode of operation, both of engine speed and travel speed are controlled responsive to actuation of a foot throttle. In a second mode of operation, the foot throttle controls travel speed, but engine speed is controlled by a hand throttle. Selection of which of the first and second modes to utilize is based upon an actuation position of the hand throttle.

In one embodiment, a power machine is disclosed. The power machine includes a frame (110); an engine (130) mounted to the frame and configured to provide a source of power; a drive system (200) operably coupled to the engine, and a control system (205) for controlling operation of the engine and the drive system. The drive system includes a drive pump (210) operably coupled to the engine and configured to be driven by the engine to provide a hydraulic power output (211); a drive motor (220) operably coupled to the drive pump and configured to receive the hydraulic power output of the drive pump, the drive motor having a rotational output member (222) configured to rotate responsive to the hydraulic power output; and tractive elements operably coupled to the drive motor and configured to cause the power machine to travel over a support surface responsive to the rotational output member of the drive motor. The control system (205) includes a hand throttle (268) configured to be actuated by an operator of the power machine to provide a hand throttle control signal (270); a foot throttle (272) configured to be actuated by the operator of the power machine to provide a foot throttle control signal (274); and a controller (250) operably coupled to the hand throttle to receive the hand throttle control signal and to the foot throttle to receive the foot throttle control signal, the controller configured to generate an engine command signal (251) to control engine speed of the engine and a drive pump command signal (252) to control the hydraulic power output of the drive pump and thereby a travel speed of the power machine. The controller is configured such that: in a first mode of operation, with the hand throttle (268) not commanded, the controller generates both of the engine command signal (251) and the drive pump command signal (252) as a function of the foot throttle control signal (274) such that engine speed and travel speed are both controlled by the foot throttle (272); and such that in a second mode of operation, with the hand throttle (268) commanded, the controller generates the engine command signal (251) as a function of the hand throttle control signal (270) such that the engine speed is controlled by the hand throttle, and the controller generates the drive pump command signal (252) as a function of the foot throttle control signal (274) such that the travel speed is controlled by the foot throttle.

In some embodiments, the controller (250) is configured to determine which of the first mode of second modes of operation to utilize based upon the hand throttle control signal.

In some embodiments, the controller is configured to determine whether the hand throttle is commanded based upon a determination of whether the hand throttle control signal indicates that the hand throttle has not surpassed a threshold hand throttle actuation percentage. The threshold hand throttle actuation percentage can be a minimum hand throttle actuation position.

In some embodiments, the controller is configured such that, in the first mode of operation, the controller generates the engine command signal and the drive pump command signal to cause the engine speed to increase as a pedal stroke percentage of the foot throttle increases from zero, but to prohibit the travel speed to increase until a lower threshold pedal stroke percentage has been surpassed.

In some embodiments, the controller is configured such that, in the first mode of operation the engine speed is controlled as a function of pedal stroke percentage using a first predefined curve, and the travel speed is controlled as a function of pedal stroke percentage using a second predefined curve. The controller is further configured such that, in the second mode of operation the travel speed is controlled as a function of pedal stroke percentage using a third predefined curve.

In some embodiments, while operating in the first mode of operation and while the power machine is traveling over the support surface, the controller is configured transition to the second mode of operation if the hand throttle begins to be commanded.

In some embodiments, the control system further comprises a control profile selection input device (276) configured to be manipulated by the operator of the power machine to select from multiple control profiles (280) for use in generating the drive pump command signal to control responsiveness of the drive pump and corresponding travel of the power machine to foot throttle actuation.

This Summary and the Abstract are provided to introduce a selection of concepts in a simplified form that are further described below in the Detailed Description. The Summary and the Abstract are not intended to identify key features or essential features of the claimed subject matter, nor are they intended to be used as an aid in determining the scope of the claimed subject matter.

BRIEF DESCRIPTION OF THE DRAWINGS

FIGS. 4-1 and 4-2 illustrate plots of vehicle or travel speed, for two separate hand throttle set engine speeds (1800 RPM and 1500 RPM), as a function of pedal stroke percentage while operating in the second mode of operation.

DETAILED DESCRIPTION OF ILLUSTRATIVE EMBODIMENTS

The concepts disclosed in this discussion are described and illustrated by referring to illustrative embodiments. These concepts, however, are not limited in their application to the details of construction and the arrangement of components in the illustrative embodiments and are capable of being practiced or being carried out in various other ways. The terminology in this document is used to describe illustrative embodiments and should not be regarded as limiting. Words such as "including," "comprising," and "having" and variations thereof as used herein are meant to encompass the items listed thereafter, equivalents thereof, as well as additional items.

In accordance with some exemplary embodiments, the present disclosure provides systems and methods of controlling engine operating speed (also referred to as "engine speed") and travel speed using a combination of a hand throttle and a foot throttle. In some exemplary embodiments, a controller is configured such that in a first mode of operation, with the hand throttle not commanded (e.g., maintained at a minimum position or below some minimum actuation percentage), the controller controls both of engine speed and a drive pump output (i.e., controls vehicle speed) responsive to only the foot throttle. The controller is also configured such that, in a second mode of operation, the hand throttle commands engine speed and the foot throttle commands the drive pump output/vehicle speed. Using these modes in a control scheme, when the hand throttle is not in the minimum position (or is below a predetermined threshold percentage of hand throttle stroke), the second mode is used to split control of the engine speed and the vehicle speed with the hand throttle controlling the engine speed and the foot throttle controlling the drive pump output and thus vehicle speed. In some exemplary embodiments, the mode is switched by the actuation position of the hand throttle. Further, in some exemplary embodiments, the controller is configured to switch from the first mode to the second mode while the power machine is traveling, but only switch from the second mode back to the first mode when the power machine is in a stationary position.

These concepts can be practiced on various power machines, as will be described below. A representative power machine on which the embodiments can be practiced is illustrated in diagram form in FIG. 1. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

Figure 1:
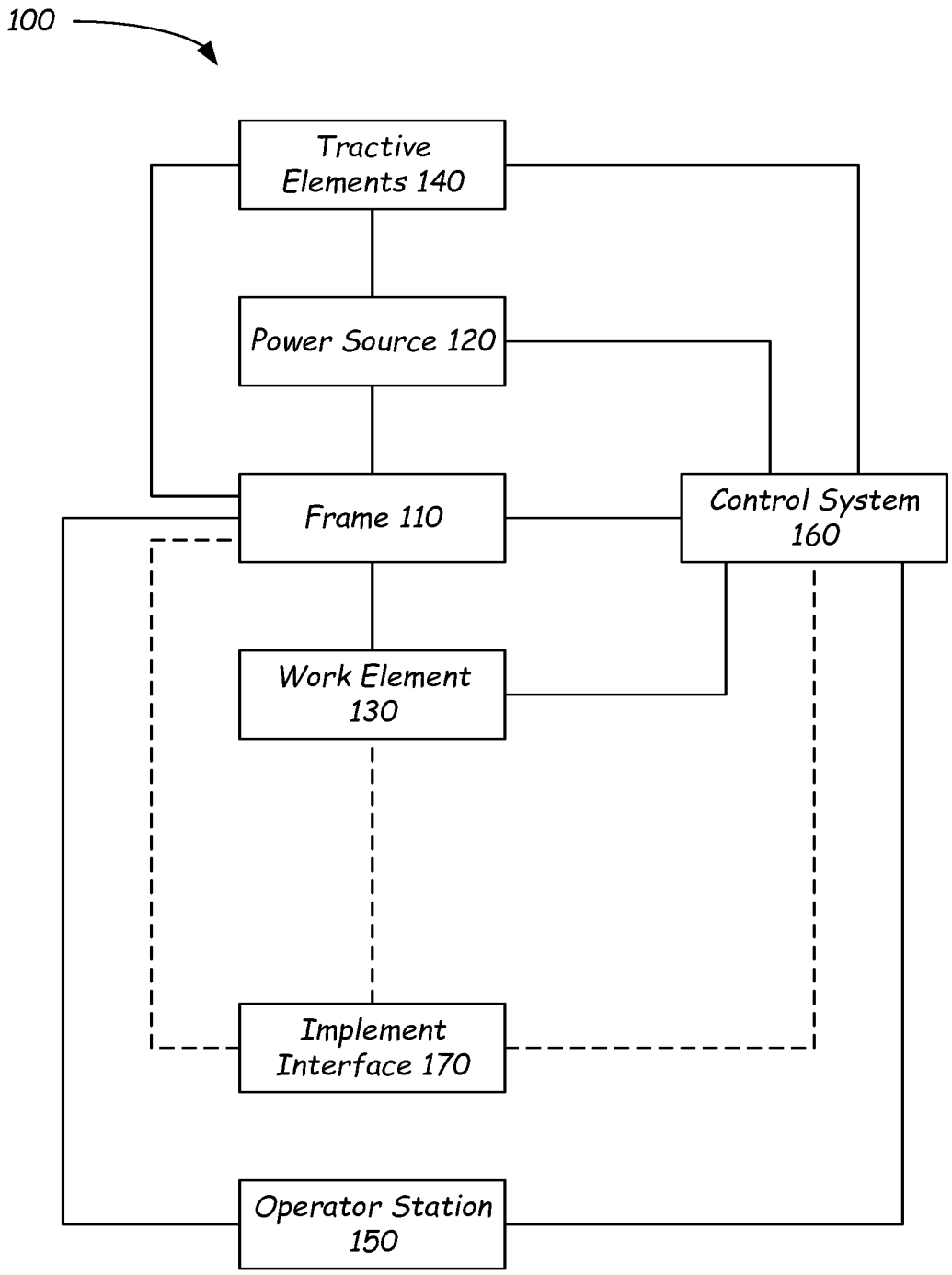
FIG. 1 is a block diagram illustrating functional systems of a representative power machine on which embodiments of the present disclosure can be advantageously practiced.

FIG. 1 is a block diagram that illustrates the basic systems of a power machine 100, which can be any of several different types of power machines, upon which the embodiments discussed below can be advantageously incorporated. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, i.e., the lift arm can be manipulated to position the implement for performing the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e., not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that is capable of moving with respect to another portion of the frame. For example, excavators can have an upper frame portion that rotates with respect to a lower frame portion. Other work vehicles have articulated frames such that one portion of the frame pivots with respect to another portion (so-called articulated frames) for accomplishing steering functions.

Frame 110 supports the power source 120, which is configured to provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that are capable of using it to perform a work function. Power sources for power machines typically include an engine such as an internal combustion engine and a power conversion system such as a mechanical transmission or a hydraulic system that is configured to convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 has an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, even if they have operator compartments or operator positions, may be capable of being operated remotely (i.e., from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e., remote from both the power machine and any implement to which is it coupled) that is capable of controlling at least some of the operator-controlled functions on the power machine.

Figure 2:
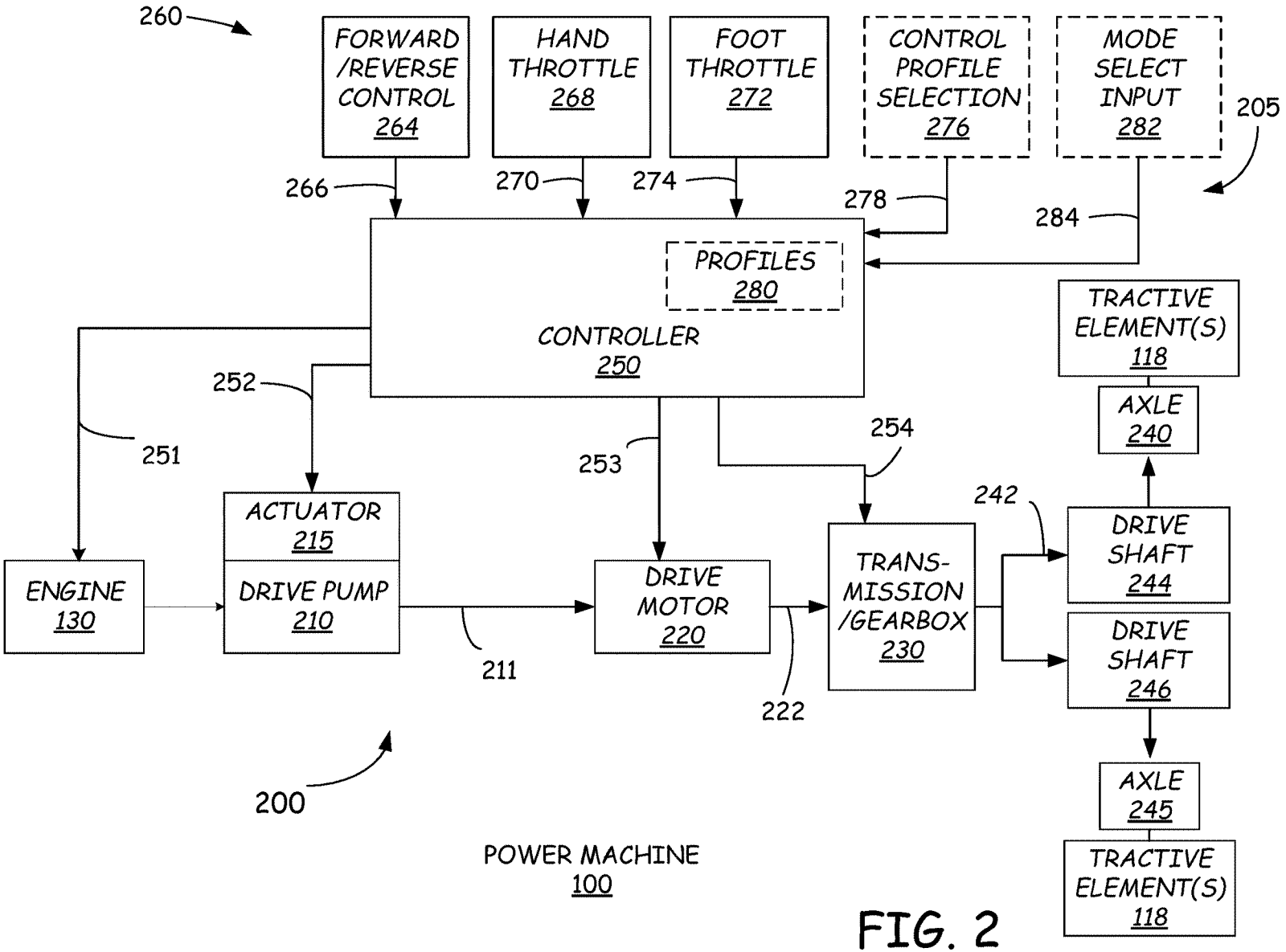
FIG. 2 is a block diagram illustrating one embodiment of drive and control systems for a power machine such as the power machine shown in FIG. 1.

FIG. 2 is a block diagram that illustrates one embodiment of a drive system 200 and a control system 205 of power machine 100 used in effecting movement or travel of the power machine. Control system 205 is selectively operable to control parameters such as engine speed and travel speed of the power machine. As shown, engine 130 is operably coupled to, and configured to power a drive pump 210 that in turn provides a hydraulic power output 211 in the form of pressurized hydraulic fluid. Drive pump 210 of this embodiment is a variable displacement pump configured to provide and receive pressurized hydraulic fluid directly to and from an actuation device such as the drive motor 220 shown in FIG. 2. Other embodiments can include drive pumps that are not variable displacement pumps. The arrangement of drive pump 210 and drive motor 220, i.e., a variable displacement pump that is directly coupled to a drive motor is sometimes collectively referred to in the art as a hydrostatic transmission or drive system. Actuator 215 is coupled to drive pump 210 and is operable to control both the direction and amount of pressurized hydraulic flow (which is the hydraulic power output 211) provided by the drive pump 210 to the drive motor 220. This hydraulic power output 211 causes the drive motor 220 to rotate in one of a first direction corresponding to forward movement of the power machine 100 and a second direction corresponding to reverse movement of the power machine 100. In other embodiments, actuator 215 controls only the amount and not the direction of hydraulic flow provided by the drive pump 210. In these embodiments, a control valve or other mechanism would be used to control the direction of hydraulic flow to the drive motor. The drive pump 210 of this embodiment is an axial piston pump and the hydraulic output 211 determined by the position of a swash plate relative to a group of pistons radially arrayed within the drive pump 210.

A rotational output member 222 of drive motor 220 is provided as an input to other downstream components of drive system 200. In the embodiment shown in FIG. 2, rotational output member 222 is a shaft that is operably coupled to and is provided as an input to a transmission or mechanical gearbox 230. The mechanical gearbox 230 then provides an output 242 to drive shafts 244 and 246, which are coupled to axles 240 and 245, respectively. Although the output 242 is shown as being tied together on one end of the gearbox 230, the output 242 can extend from each side of the gearbox with a drive shaft coupled to the end in other embodiments. Each of the axles 240 and 245 are configured to drive one or more wheels 118 or other tractive elements (such as, for example, track assemblies) as shown in FIG. 1. Various configurations can be adapted to convert a drive output from the gearbox 230 to the wheels 118 and that this example is but one possible arrangement. In other embodiments, the gearbox can drive one of the axles directly with the other axle being driven through a drive shaft coupled to an output of the gearbox. In still other embodiments, drive systems that do not utilize a gearbox are also incorporated.

Drive system 200 is an electrically controlled drive system having a control system 205 with a controller 250, responsive to one or more user input devices 260, and configured to control one or more of engine speed and operation, drive pump displacement and direction, drive motor operation, and gearbox operation by generating command signals 251-254. In exemplary embodiments as described below, controller 250 is configured to control engine speed and drive pump displacement (and thereby travel speed) utilizing a combination of first and second throttle inputs and according to a control configuration of the throttle inputs in at least first and second modes.

In the control system 205, one or more user input devices 260 are manipulable to provide input signals to controller 250 indicative of an operator's intention to control various functions on the power machine, including causing the power machine 100 to move over a support surface. In an exemplary embodiment, input devices 260 include a forward/reverse or direction control input 264 which generates a command signal 266 for use by the controller in commanding a direction of hydraulic fluid flow in drive pump 210 to dictate forward or reverse travel of the power machine. Input devices 260 also include a hand throttle 268 configured to be actuated by an operator's hand between a minimum stroke position and a maximum stroke position. Responsive to the actuation, the hand throttle generates a command signal 270 for use by the controller in commanding or setting engine speeds in certain modes of operation as will be discussed below in greater detail. Input devices 260 also include a foot throttle or pedal 272 configured to be actuated by an operator's foot between a minimum stroke position and a maximum stroke position. Responsive to the actuation, the foot throttle generates a command signal 274 for use by the controller in commanding or setting the drive pump output and thereby travel speed. As described further below, in at least one mode of operation the command signal 274 from the foot throttle also commands or sets engine speed. Input devices 260 can also include other input devices, such as a steering wheel or other steering device, for steering the power machine while moving in the forward or rearward direction. Still other input devices can include switches, push buttons, touch screen inputs and the like for controlling other machine functions.

In some exemplary embodiments, such other input devices can optionally include a control profile selection input 276 which generates a command signal 278 to allow an operator to select from multiple possible control profiles 280, stored in memory associated with controller 250, to control responsiveness of the drive pump (and thus travel functions) to different degrees of foot throttle actuation. Further, in some embodiments, input devices 260 can include a mode selection switch or input 282 which generates a command signal 284 to allow an operator to select from multiple different modes of operation, such as an "Economy" or "Eco" mode and an "Overspeed" mode. In some examples of such optional modes of operation, engine speed of engine 130 can be set to a constant value or a minimum value by one input device such as hand throttle 268, while vehicle speed is controlled with another input device such as foot throttle 272. Also, the maximum vehicle speed can be limited for example by the hand throttle in one mode, while in another mode the maximum vehicle speed is controlled by the foot throttle. These optional modes of operation are described further with reference to FIG. 7.

In control system 205, responsive to inputs from user inputs 260, controller 250 provides one or more of command signals 251-254 to components of drive system 200 to control the engine 130, drive pump 210, drive motor 220, and gearbox 230, respectively. Unless otherwise discussed below, control schemes for these components are not limiting on any particular embodiment of this application. Although a single machine controller 250 is illustrated in FIG. 2, in some embodiments separate controllers can be used to control different components of the drive system. In addition, in some embodiments a controller that controls drive system functions can also perform other functions related to the power machine 100.

As discussed, in exemplary embodiments, control system 205 is configured to operate to control engine speed using a first mode and a second mode, with the mode selected based upon the actuation position of the hand throttle. In the first mode (MODE 1), hand throttle 268 is not commanded. In other words, the hand throttle is maintained at a minimum actuation position or below some minimum actuation threshold position (e.g., not more than 10% actuation). In this first mode of operation, both of the engine speed and the travel speed are controlled responsive to the operator's actuation of the foot throttle or pedal 272.

Figure 3:
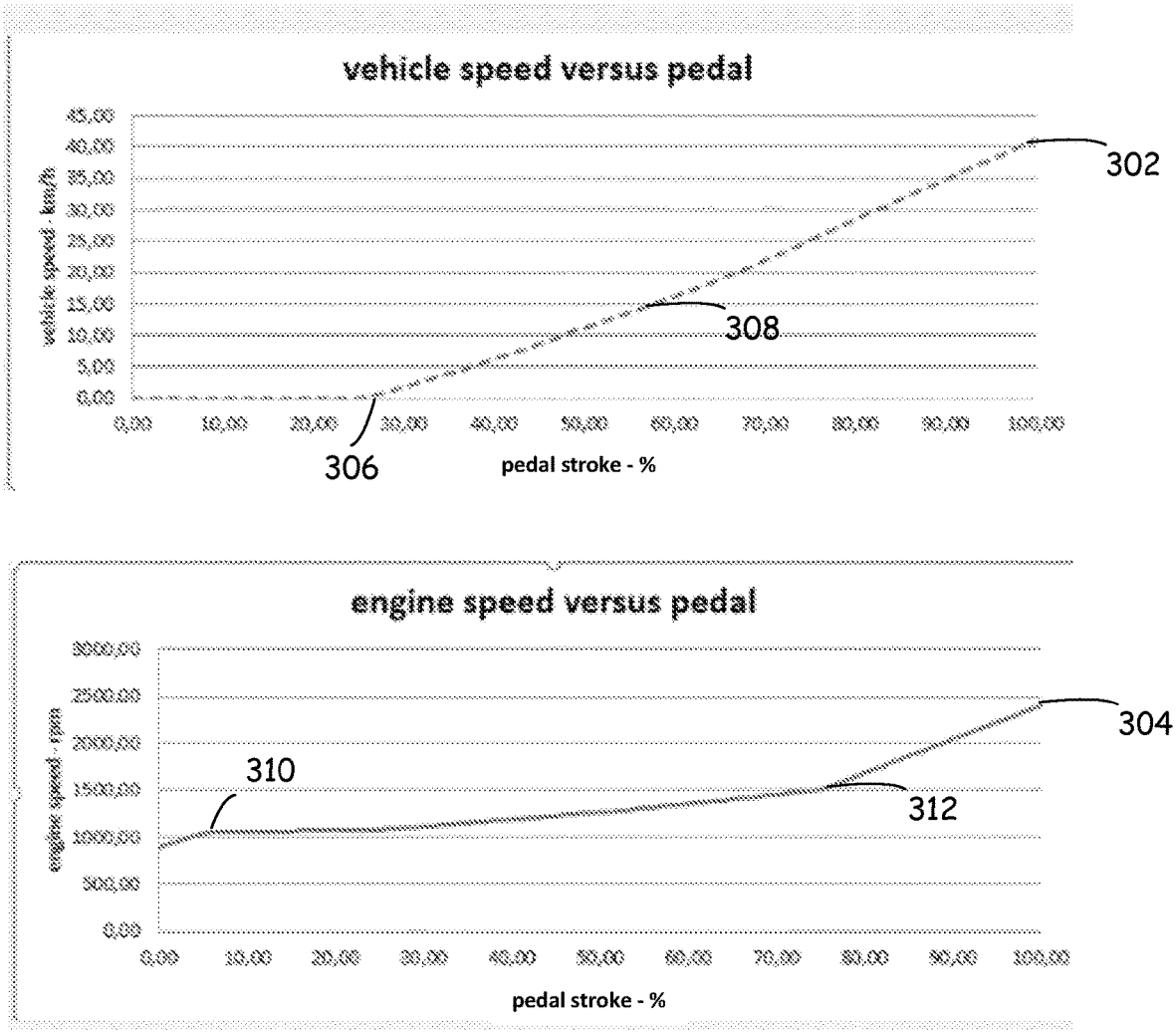
FIG. 3 illustrates plots of vehicle or travel speed, and engine speed, both as a function of foot throttle stroke percentage ("pedal stroke percentage") while operating in a first mode of operation in an exemplary embodiment.

FIG. 3 illustrates plots of vehicle or travel speed, and engine speed, both as a function of foot throttle stroke percentage ("pedal stroke percentage") while operating in the first mode of operation. As can be seen in the plots of FIG. 3, the vehicle speed curve or function 302 and the engine speed curve or function 304 both vary based upon the pedal stroke percentage of the foot throttle, but they do so without a directly dependent relationship. For instance, in at least the illustrated embodiment, as the pedal stroke percentage increases from zero (the non-actuated position), vehicle speed remains at zero until some lower threshold pedal stroke percentage (shown at 306) is reached. The power machine can be maintained in this neutral state, with zero travel speed, using any desired technique. For instance, using command signal 254 to transmission or gearbox 230, the drive motor output 222 can be prevented from being transferred to output 242 to drive shafts 244 and 246 until the lower threshold pedal stroke is reached. Over this same range of pedal stroke percentages, engine speed increases according to a predetermined function or relationship to the pedal stroke percentage.

After the lower threshold pedal stroke percentage is reached, each of the vehicle speed and the engine speed are increased by controller 250 using the predefined curves or functions 302 and 304. In the case of controlling vehicle speed, this can include controller 250 using command signal 254 to shift transmission or gearbox 230 such that drive motor output 222 is transferred to output 242 to drive shafts 244 and 246. The shapes of curves or functions 302 and 304 can define any suitable relationships between the vehicle speed and engine speed, respectively, and the pedal stroke percentage. For instance, the curves or functions can increase according to stepwise linear relationships or according to non-linear relationships. In the particular embodiment illustrated, the predefined curves or functions 302 and 304 include one or more inflection points (e.g., 308, 310 and 312) where the slope of the curves or functions increases or decreases at a higher rate of change than is the case in portions of the curves before or after the inflection point. This need not be the case in all embodiments. Further, illustrated vehicle and engine speeds are provided as examples only, and can vary in other embodiments. While illustrated in examples with particular vehicle and engine speeds, the example relations illustrated in the plots of FIG. 3 could alternatively be represented as percentages of a maximum speed (e.g., a Vmax).

In the second mode (MODE 2), the hand throttle 268 is commanded (actuated above the minimum actuation position or the minimum actuation threshold position) and controller 250 sets the engine speed based upon the actuation position of the hand throttle. In exemplary embodiments, in the second mode engine speed is established solely based upon the actuation position of the hand throttle. However, that need not be the case in all embodiments as engine speed can be set based upon a combination of hand throttle actuation position and pedal stroke percentage or other power machine parameters such as commanded lift arm operation or operation of other non-travel hydraulic system functions. In the second mode of operation, controller 250 controls vehicle speed based upon the pedal stroke percentage.

Figures 1, 4:
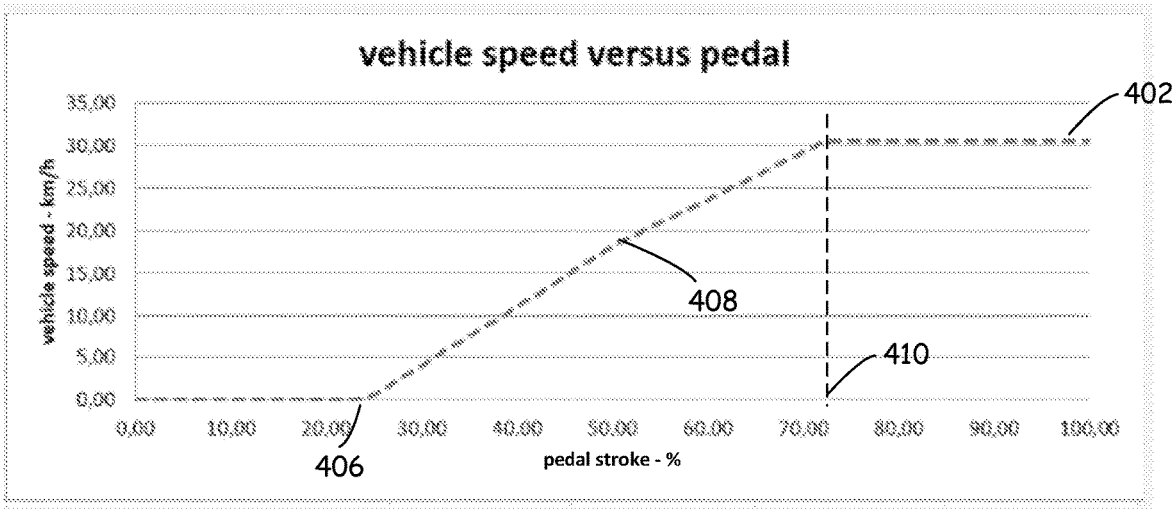
Figures 2, 4:
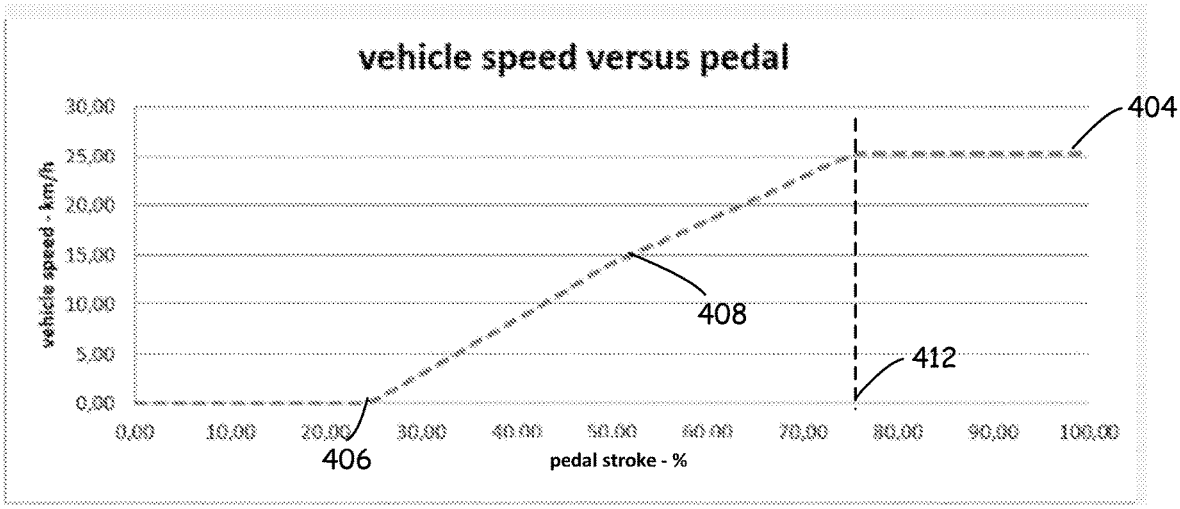

FIGS. 4-1 and 4-2 illustrate plots of vehicle or travel speed, for two separate hand throttle set engine speeds (1800 RPM and 1500 RPM), as a function of pedal stroke percentage while operating in the second mode of operation. In this example embodiment, as the pedal stroke percentage increases from zero (the non-actuated position), vehicle speed remains at zero until some lower threshold pedal stroke percentage (shown at 406) is reached, as was the case when operating in the first mode of operation. This need not be the case in all embodiments. Vehicle speed then increases as a predefined function of pedal stroke percentage, according to a curves or functions 402 and 404, while engine speed remains at the hand throttle commanded speed. Again, the shapes of curves or functions 402 and 404 can define any suitable relationships between the vehicle speed and the pedal stroke percentage. For instance, in the illustrated embodiments, vehicle speed increases for pedal stroke percentages between the lower threshold pedal stroke percentage 406 and an upper threshold pedal stroke percentage 410, 412, but does not increase for pedal stroke percentages above the upper threshold pedal stroke percentage 410, 412. Note that the upper threshold pedal stroke percentages 410, 412 need not be the same at different set engine speeds. Further, while both of curves or functions 402 and 404 include an inflection point 408 between the lower threshold pedal stroke percentage 406 and an upper threshold pedal stroke percentage 410, 412, the inflection points at which the slopes of the curves increase or decrease more rapidly need not be at the same pedal stroke percentage for different engine speeds. As was the case with FIG. 3, the illustrated vehicle speeds are provided as examples only, and can vary in other embodiments. While illustrated in examples with particular vehicle speeds, the example relations illustrated in the plots of FIGS. 4-1 and 4-2 could alternatively be represented as percentages of a maximum speed (e.g., a Vmax).

Figure 5:
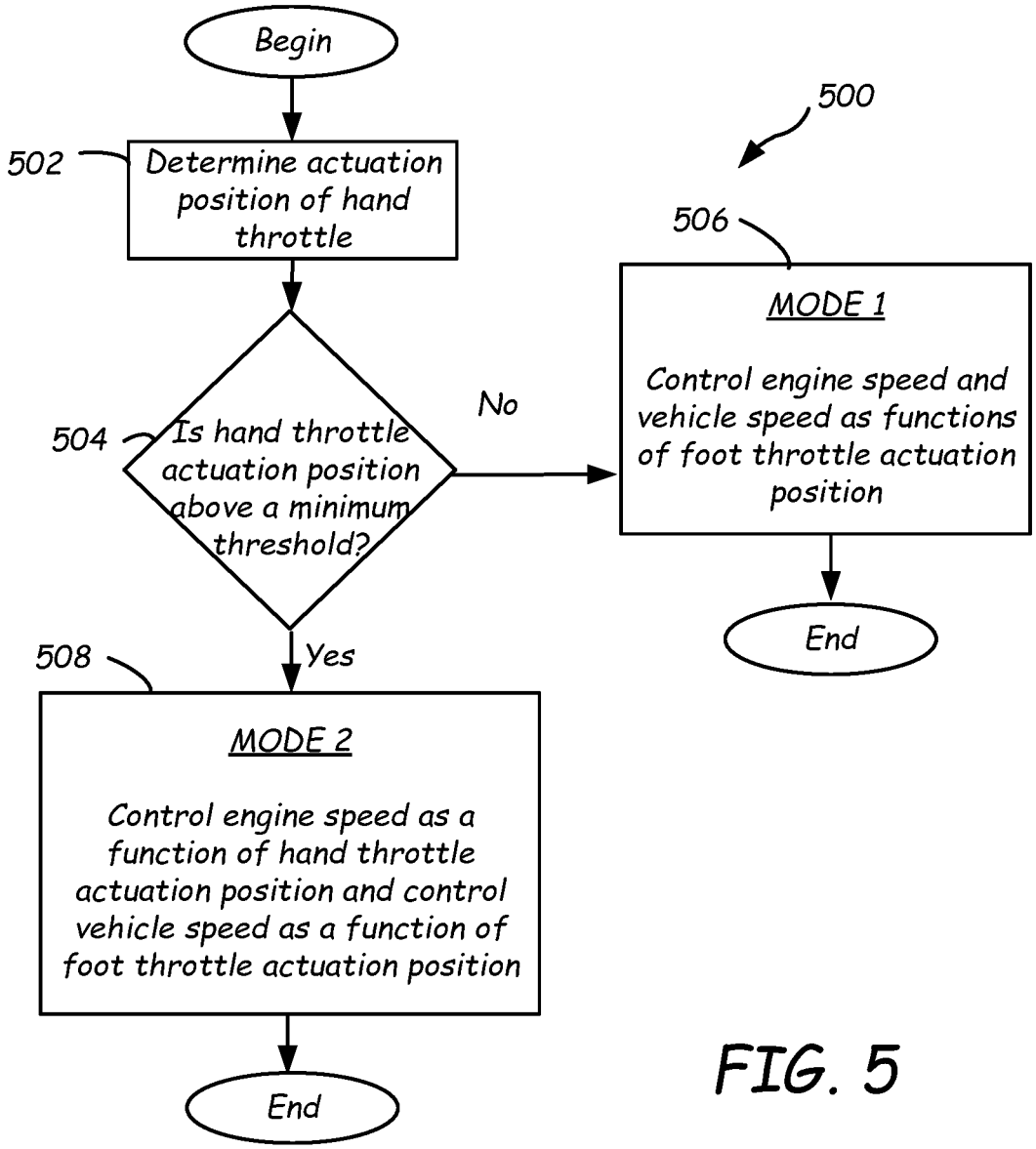
FIG. 5 is a flow diagram illustrating a method of controlling an engine and a drive system for a power machine, using first and second modes of operation, in accordance with an exemplary embodiment.

Referring now to FIG. 5, shown is a method 500 of controlling engine speed and travel speed of a power machine in accordance with some exemplary embodiments. At block 502, controller 250 determines, from command signal 270, the actuation position of hand throttle 268. At block 504, the controller determines whether the hand throttle actuation position is above a predetermined minimum threshold position. For example, the minimum actuation position can be a set percentage, for example ten percent, of the actuation range of the hand throttle. If it is determined that the hand throttle is not above the minimum threshold position, the controller operates in the first mode of operation as shown at block 506, controlling both of engine speed and vehicle speed as functions of the actuation position. Alternatively, if it is determined at block 504 that the hand throttle actuation position is above the predetermined minimum threshold, then the controller operates in the second mode of operation as shown at block 508, controlling engine speed as a function of the hand throttle actuation position and controlling vehicle speed as a function of the foot throttle actuation position.

Figure 6:
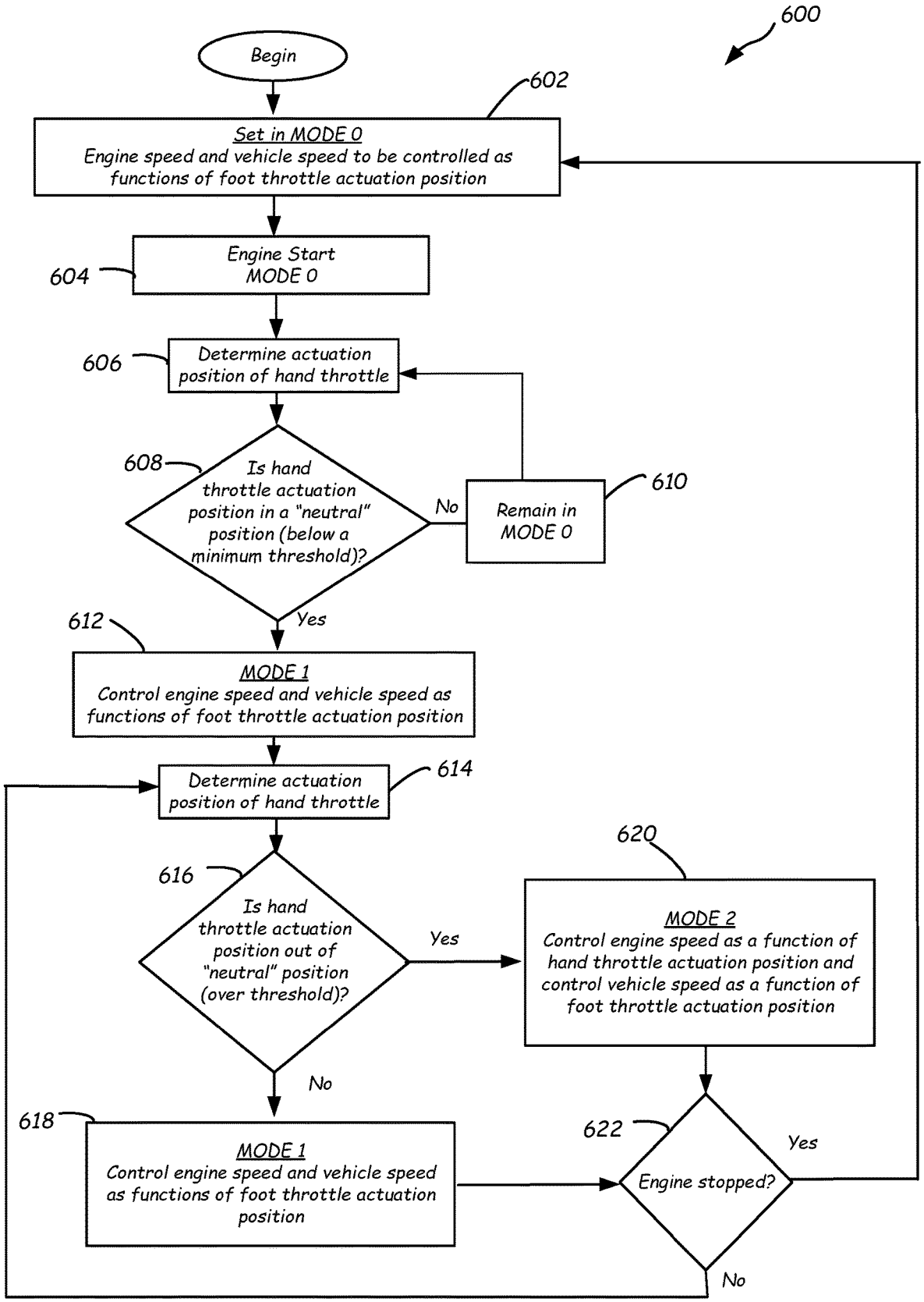
FIG. 6 is a flow diagram illustrating another method of controlling an engine and a drive system for a power machine, using three modes of operation, in accordance with an exemplary embodiment in which transition between modes is controlled.

FIG. 6 illustrates another method 600 of controlling engine speed and travel speed of a power machine in accordance with other exemplary embodiments. The method 600 incorporates concepts discussed above in method 500 related to determination of whether to operate in the first mode of operation (MODE 1) or the second mode of operation (MODE 2), but includes an additional starting mode (MODE 0), and describes transition between modes. As such, at block 602, controller 250 sets an operational mode for engine start (MODE 0). In this starting mode, which is functionally the same as the first mode, the controller establishes that both of engine speed and vehicle speed are to be controlled by the foot throttle actuation position. This prevents an engine start at high engine speed if the hand throttle is actuated at the time of the engine starting. At block 604, the engine is started, for example in response to a user input initiating such action, and engine speed is set based upon the foot throttle position. As will be discussed further below, the engine start mode (MODE 0) differs from the first mode of operation (MODE 1) only with respect to allowed transitions from one mode to the next.

After the engine of the power machine is started, controller 250 determines, from command signal 270, the actuation position of the hand throttle as shown at block 606. From this determination, the controller determines at block 608 whether the handle throttle is below a minimum threshold. If controller 250 determines that the hand throttle is not below the minimum threshold, the mode remains in the start engine mode as shown at block 610, and engine speed and vehicle speed are both controlled by the foot throttle. However, if (or once) the hand throttle is determined to be below the minimum threshold, controller 250 sets the mode of operation to the first mode of operation as shown at block 612. In this first mode of operation, engine speed and vehicle speed are still both controlled by the foot throttle. Note that transition from the start engine mode to the second mode of operation is not allowed.

After entering the first mode of operation as shown at block 612, controller 250 again determines, from command signal 270, actuation position information for hand throttle 268 as shown at block 614. At block 616, the controller determines whether the hand throttle actuation position is above or below the predetermined minimum threshold position. If it is determined that the hand throttle is below the minimum threshold position, the controller operates in the first mode of operation as shown at block 618, controlling both of engine speed and vehicle speed as functions of the actuation position of foot throttle 272. Alternatively, if it is determined at block 616 that the hand throttle actuation position is over the predetermined minimum threshold, then the controller operates in the second mode of operation as shown at block 620, controlling engine speed as a function of the hand throttle actuation position and controlling vehicle speed as a function of the foot throttle actuation position. In various embodiments, a hand throttle actuation position equal to the minimum threshold can be established to be either "under" or "over" the minimum threshold for purposes of setting the appropriate mode.

With the power machine set to utilize the first or second modes as shown at blocks 618 and 620, the controller monitors whether the engine has stopped as shown at block 622. So long as the engine has not stopped, the controller continues to monitor the hand throttle actuation position (shown at blocks 614 and 616), and switches between the first and second modes based upon hand throttle actuation position. However, if the engine has stopped, the controller again sets the engine start mode (as shown at block 602), and after another engine start will require the hand throttle to be at a position under the minimum threshold, and then over the minimum threshold, before allowing a transition to the second mode in which the hand throttle controls engine speed.

In addition to the various disclosed embodiments in which the hand throttle is used to select which mode of operation, separate or combined control of engine speed and travel speed, some embodiments also provide the capability for the operator to choose different control profiles 280 for the power machine using a control profile selection input device 276 as shown in FIG. 2. The control profile selection input can be a touch screen display, a switch, a push button selector, or other devices. In some embodiments the selectable control profiles can include at least a first control profile and a second control profile. Each of the control profiles can be used to configure controller 250 to establish different control curves or functions relating the foot throttle position (pedal stroke percentage) to particular engine speeds and/or vehicle speeds. For example, the control profiles can have different curve slopes to increase or decrease responsiveness of vehicle speed (e.g., increase or decrease speed variations for a set change in foot pedal stroke percentage). By selecting a particular control profile 280, the drive system responsiveness can be tailored for particular tasks, operator preferences, etc. Further, in some embodiments, instead of the operator selecting particular control profiles and the associated control curves, separate control profiles can be assigned for each of the first and second modes of operation discussed above such that the controller automatically uses the control profile associated with a particular mode of operation.

Figure 7:
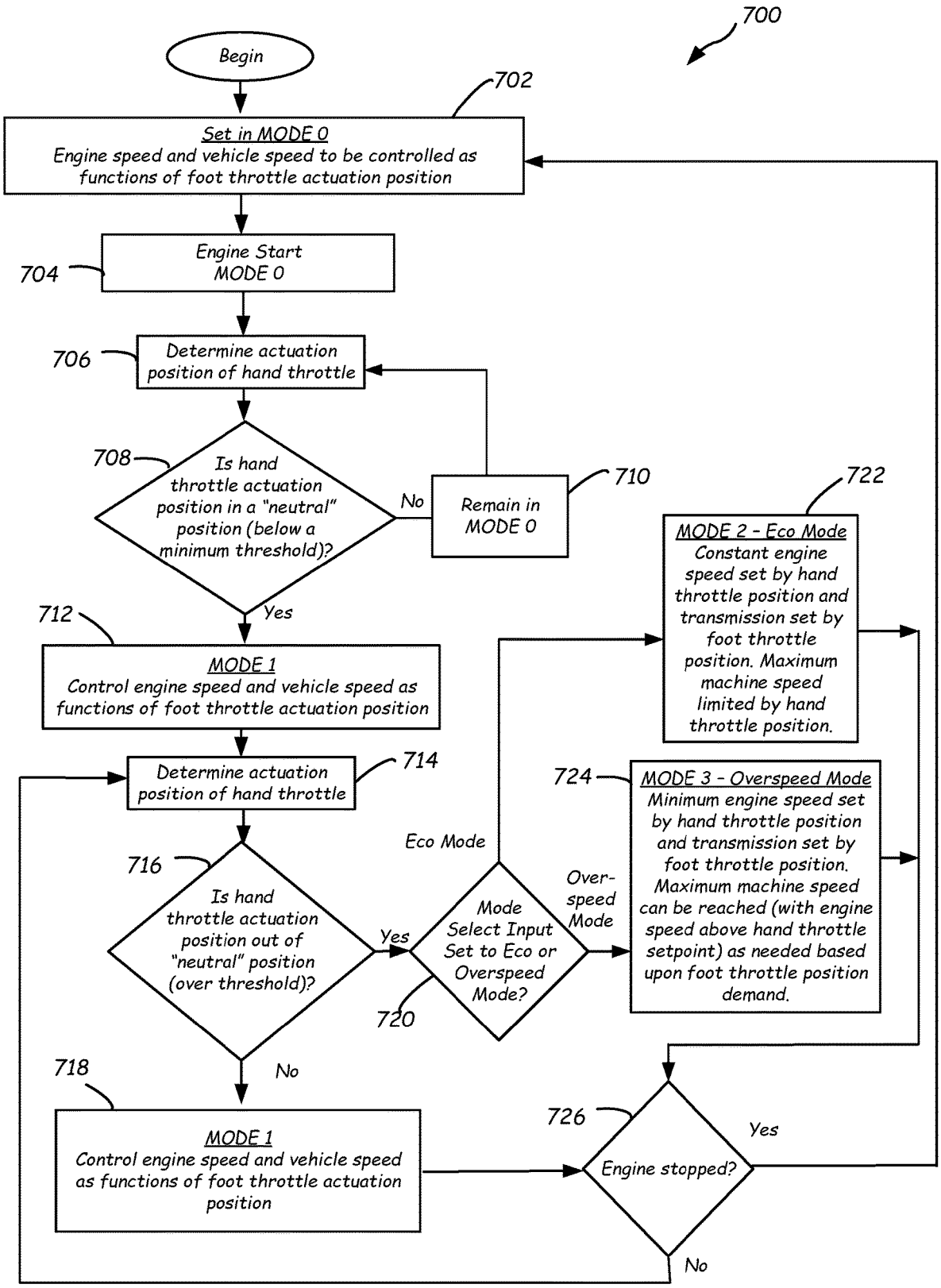
FIG. 7 is a flow diagram illustrating another method of controlling an engine and a drive system for a power machine, using four modes of operation, in accordance with an exemplary embodiment in which the hand throttle is used to set either a constant engine speed or a minimum engine speed.

FIG. 7 illustrates another method 700 of controlling engine speed and travel speed of a power machine in accordance with other exemplary embodiments. The method 700 is similar to method 600 discussed above, but incorporates different hand throttle modes of operation, for example including an Eco Mode and an Overspeed mode. In these example modes, the hand throttle can be used to set a constant engine speed, or alternatively a minimum engine speed. The foot throttle can then be used to control the transmission (gearbox) and thereby vehicle speed. These modes are discussed further below.

In this exemplary embodiment, like method 600, at block 702 of method 700, controller 250 sets an operational mode for engine start (MODE 0). In this starting mode, which is functionally the same as the first mode, the controller establishes that both of engine speed and vehicle speed are to be controlled by the foot throttle actuation position. This prevents an engine start at high engine speed if the hand throttle is actuated at the time of the engine starting. At block 704, the engine is started, for example in response to a user input initiating such action, and engine speed is set based upon the foot throttle position. As will be discussed above with reference to FIG. 6, the engine start mode (MODE 0) differs from the first mode of operation (MODE 1) only with respect to allowed transitions from one mode to the next. It should be understood that method 700 need not include an engine start mode or the activity of block 702 in all embodiments.

After the engine of the power machine is started, controller 250 determines, from command signal 270, the actuation position of the hand throttle as shown at block 706. From this determination, the controller determines at block 708 whether the handle throttle is in a neutral position (e.g., below a minimum threshold). If controller 250 determines that the hand throttle is not below the minimum threshold, the mode remains in the start engine mode as shown at block 710, and engine speed and vehicle speed are both controlled by the foot throttle. However, if (or once) the hand throttle is determined to be below the minimum threshold, controller 250 sets the mode of operation to the first mode of operation as shown at block 712. In this first mode of operation, engine speed and vehicle speed are still both controlled by the foot throttle, but transition to second or third modes of operation in which the hand throttle controls aspects of engine speed is now allowed. Note that transition from the start engine mode to the second or third mode of operation is not allowed.

After entering the first mode of operation as shown at block 712, controller 250 again determines, from command signal 270, actuation position information for hand throttle 268 as shown at block 714. At block 716, the controller determines whether the hand throttle actuation position is above or below the predetermined minimum threshold position. If it is determined that the hand throttle is below the minimum threshold position, the controller operates in the first mode of operation as shown at block 718, controlling both of engine speed and vehicle speed as functions of the actuation position of foot throttle 272.

Alternatively, if it is determined at block 716 that the hand throttle actuation position is over the predetermined minimum threshold, then the controller determines which of multiple hand throttle modes of operation should be utilized. To this end, at block 720, the controller determines the hand throttle mode of operation based upon the command signal 284 from mode select input 282. In one exemplary embodiment, the hand throttle modes of operation include at least two hand throttle modes—an Eco Mode (MODE 2) and an Overspeed Mode (MODE 3). In this embodiment, if the controller determines at block 720 that the mode select input 282 indicates the Eco mode of operation, at block 722 the controller sets the engine speed to a constant RPM value based upon the hand throttle actuation position. In this mode, the controller controls the gearbox or transmission 230 to set the gear ratio based upon the actuation of foot throttle 272. In this Eco Mode, with the transmission controlled by the foot throttle, travel speed of the power machine is controlled by the foot throttle, but the maximum power machine travel speed is limited by the hand throttle position and the corresponding commanded constant engine speed.

If the controller determines at block 720 that the mode select input 282 indicates the Overspeed mode of operation, at block 724 the controller sets a minimum engine speed or setpoint based upon the hand throttle actuation position, but the controller increases engine speed based upon foot pedal position. In this mode, the controller again controls the gearbox or transmission 230 to set the gear ratio based upon the actuation of foot throttle 272. However, with engine speed being allowed to surpass the minimum set by the hand throttle, in this Overspeed Mode, a higher maximum power machine travel speed can be achieved because the engine speed increases beyond the minimum engine speed if needed based upon the demands of the foot throttle actuation position.

With the power machine set to utilize the first, second or third modes as shown at blocks 718, 722 and 724, the controller monitors whether the engine has stopped as shown at block 726. So long as the engine has not stopped, the controller continues to monitor the hand throttle actuation position (shown at blocks 714 and 716) and the mode select input (shown at block 720), and switches between the first, second and third modes based upon hand throttle actuation position and mode select input. However, if the engine has stopped, the controller again sets the engine start mode (as shown at block 702), and after another engine start will require the hand throttle to be at a position under the minimum threshold, and then over the minimum threshold, before allowing a transition to the second mode in which the hand throttle controls engine speed.

Although the present invention has been described with reference to preferred embodiments, workers skilled in the art will recognize that changes may be made in form and detail without departing from the spirit and scope of the invention.

What is claimed is:

1. A power machine, comprising:

a frame;

an engine mounted to the frame and configured to provide a source of power;

a drive system operably coupled to the engine, the drive system comprising:

a drive pump operably coupled to the engine and configured to be driven by the engine to provide a hydraulic power output;

a drive motor operably coupled to the drive pump and configured to receive the hydraulic power output of the drive pump, the drive motor having a rotational output member configured to rotate responsive to the hydraulic power output; and tractive elements operably coupled to the drive motor and configured to cause the power machine to travel over a support surface responsive to the rotational output member of the drive motor; and a control system for controlling operation of the engine and the drive system, the control system comprising:

a hand throttle configured to be actuated by an operator of the power machine to provide a hand throttle control signal;

a foot throttle configured to be actuated by the operator of the power machine to provide a foot throttle control signal; and a controller operably coupled to the hand throttle to receive the hand throttle control signal and to the foot throttle to receive the foot throttle control signal, the controller configured to generate an engine command signal to control engine speed of the engine and a drive pump command signal to control the hydraulic power output of the drive pump and thereby a travel speed of the power machine, wherein the controller is configured such that:

in a first mode of operation, with the hand throttle not commanded, the controller generates both of the engine command signal and the drive pump command signal as a function of the foot throttle control signal such that engine speed and travel speed are both controlled by the foot throttle, wherein in the first mode of operation the engine speed is controlled as a function of a pedal stroke percentage using a first predefined curve, and the travel speed is controlled as a function of pedal stroke percentage using a second predefined curve; and in a second mode of operation, with the hand throttle commanded, the controller generates the engine command signal as a function of the hand throttle control signal such that the engine speed is controlled by the hand throttle, and the controller generates the drive pump command signal as a function of the foot throttle control signal such that the travel speed is controlled by the foot throttle.

2. The power machine of claim 1, wherein the controller is configured to determine which of the first mode of second modes of operation to utilize based upon the hand throttle control signal.

3. The power machine of claim 2, wherein the controller is configured to determine whether the hand throttle is commanded based upon a determination of whether the hand throttle control signal indicates that the hand throttle has not surpassed a threshold hand throttle actuation position.

4. The power machine of claim 3, wherein the threshold hand throttle actuation position is a minimum hand throttle actuation position.

5. The power machine of claim 1, wherein the controller is configured such that, in the first mode of operation, the controller generates the engine command signal and the drive pump command signal to cause the engine speed to increase as a pedal stroke percentage of the foot throttle increases from zero, but to prohibit the travel speed to increase until a lower threshold pedal stroke percentage has been surpassed.

6. The power machine of claim 1, wherein the controller is configured such that, in the second mode of operation the travel speed is controlled as a function of pedal stroke percentage using a third predefined curve.

7. The power machine of claim 1, wherein while operating in the first mode of operation, the controller is configured to transition to the second mode of operation if the hand throttle begins to be commanded.

8. The power machine of claim 1, wherein the control system further comprises a control profile selection input device configured to be manipulated by the operator of the power machine to select from multiple control profiles for use in generating the drive pump command signal to control responsiveness of the drive pump and corresponding travel of the power machine to foot throttle actuation.

9. A power machine, comprising:

a frame;

an engine mounted to the frame and configured to provide a source of power;

a drive system operably coupled to the engine, the drive system comprising:

a drive pump operably coupled to the engine and configured to be driven by the engine to provide a hydraulic power output;

a drive motor operably coupled to the drive pump and configured to receive the hydraulic power output of the drive pump, the drive motor having a rotational output member configured to rotate responsive to the hydraulic power output; and tractive elements operably coupled to the drive motor and configured to cause the power machine to travel over a support surface responsive to the rotational output member of the drive motor; and a control system for controlling operation of the engine and the drive system, the control system comprising:

a hand throttle configured to be actuated by an operator of the power machine to provide a hand throttle control signal;

a foot throttle configured to be actuated by the operator of the power machine to provide a foot throttle control signal; and a controller operably coupled to the hand throttle to receive the hand throttle control signal and to the foot throttle to receive the foot throttle control signal, the controller configured to generate an engine command signal to control engine speed of the engine and a drive pump command signal to control the hydraulic power output of the drive pump and thereby a travel speed of the power machine, wherein the controller is configured such that:

in a first mode of operation, with the hand throttle not commanded, the controller generates both of the engine command signal and the drive pump command signal as a function of the foot throttle control signal such that engine speed and travel speed are both controlled by the foot throttle;

in a second mode of operation, with the hand throttle commanded, the controller generates the engine command signal as a function of the hand throttle control signal such that the engine speed is controlled by the hand throttle, and the controller generates the drive pump command signal as a function of the foot throttle control signal such that the travel speed is controlled by the foot throttle; and wherein at engine start up, in a start up mode of operation, the controller is configured to generate both of the engine command signal and the drive pump command signal as a function of the foot throttle control signal such that engine speed and travel speed are both controlled by the foot throttle regardless of a hand throttle actuation position, wherein the controller allows transition from the start up mode of operation to the first mode of operation but prohibits transition from the start up mode of operation directly to the second mode of operation, and wherein after engine start up, the controller only allows an initial transition to the second mode of operation after the hand throttle actuation position is determined to be first below a threshold hand throttle actuation position and then above the threshold hand throttle actuation position.

10. The power machine of claim 9, wherein the controller is configured to determine which of the first mode of second modes of operation to utilize based upon the hand throttle control signal.

11. The power machine of claim 10, wherein the controller is configured to determine whether the hand throttle is commanded based upon a determination of whether the hand throttle control signal indicates that the hand throttle has not surpassed a threshold hand throttle actuation position.

12. The power machine of claim 11, wherein the threshold hand throttle actuation position is a minimum hand throttle actuation position.

13. The power machine of claim 9, wherein the controller is configured such that, in the first mode of operation, the controller generates the engine command signal and the drive pump command signal to cause the engine speed to increase as a pedal stroke percentage of the foot throttle increases from zero, but to prohibit the travel speed to increase until a lower threshold pedal stroke percentage has been surpassed.

14. The power machine of claim 9, wherein while operating in the first mode of operation, the controller is configured to transition to the second mode of operation if the hand throttle begins to be commanded.

15. The power machine of claim 9, wherein the control system further comprises a control profile selection input device configured to be manipulated by the operator of the power machine to select from multiple control profiles for use in generating the drive pump command signal to control responsiveness of the drive pump and corresponding travel of the power machine to foot throttle actuation.

16. A power machine, comprising:

a frame;

an engine mounted to the frame and configured to provide a source of power;

a drive system operably coupled to the engine, the drive system comprising:

a drive pump operably coupled to the engine and configured to be driven by the engine to provide a hydraulic power output;

a drive motor operably coupled to the drive pump and configured to receive the hydraulic power output of the drive pump, the drive motor having a rotational output member configured to rotate responsive to the hydraulic power output;

a transmission operably coupled to the rotational output member of the drive motor and configured to provide an output responsive to rotation of the rotational output member;

tractive elements operably coupled to the transmission and configured to cause the power machine to travel over a support surface responsive to the output of the transmission; and a control system for controlling operation of the engine and the drive system, the control system comprising:

a hand throttle configured to be actuated by an operator of the power machine to provide a hand throttle control signal;

a foot throttle configured to be actuated by the operator of the power machine to provide a foot throttle control signal;

a mode selection input configured to provide a mode selection command signal indicative of a selected mode from multiple different modes of operation; and a controller operably coupled to the hand throttle to receive the hand throttle control signal, to the foot throttle to receive the foot throttle control signal, and to the mode selection input to receive the mode selection command signal, the controller configured to generate an engine command signal to control engine speed of the engine, and a transmission command signal to control shifting of the transmission, wherein the controller is configured such that:

in a first mode of operation, with the hand throttle not commanded, the controller generates both of the engine command signal and the transmission command signal as a function of the foot throttle control signal such that engine speed and the transmission are both controlled by the foot throttle; and in a second mode of operation, with the hand throttle commanded and the mode selection command signal indicative of selection of the second mode of operation, the controller generates the engine command signal as a function of the hand throttle control signal such that the engine speed is set to a constant engine speed by the hand throttle, and the controller generates the transmission command signal to control shifting of the transmission as a function of the foot throttle control signal such that the transmission is controlled by the foot throttle; and in a third mode of operation, with the hand throttle commanded and the mode selection command signal indicative of selection of the third mode of operation, the controller generates the engine command signal as a function of the hand throttle control signal such that a minimum engine speed is set by the hand throttle, and the controller generates the transmission command signal to control shifting of the transmission as a function of the foot throttle control signal such that the transmission is controlled by the foot throttle.

17. The power machine of claim 16, wherein in second mode of operation, a maximum power machine travel speed over the support surface is limited by the hand throttle actuation position and corresponding constant engine speed.

18. The power machine of claim 17, wherein in the third mode of operation, the controller generates the engine command signal also as a function of the foot throttle control signal such that engine speed surpasses the set minimum engine speed when commanded by the foot throttle.

19. The power machine of claim 16, wherein the controller is configured to determine whether the hand throttle is commanded based upon a determination of whether the hand throttle control signal indicates that the hand throttle has not surpassed a threshold hand throttle actuation percentage.

20. The power machine of claim 19, wherein the threshold hand throttle actuation percentage is a minimum hand throttle actuation position.

* * * * *